US005441862A

United States Patent [19]

Weber et al.

[11] Patent Number: 5,441,862

[45] Date of Patent: Aug. 15, 1995

[54] COLOR PHOTOGRAPHIC RECORDING MATERIAL

[75] Inventors: Beate Weber, Leichlingen; Günter Helling, Odenthal; Markus Geiger, Langenfeld, all of Germany

[73] Assignee: Agfa-Gevaert AG, Leverkusen, Germany

[21] Appl. No.: 329,886

[22] Filed: Oct. 27, 1994

[30] Foreign Application Priority Data

Nov. 8, 1993 [DE] Germany ..... 43 38 105.7

[51] Int. Cl.[6] ..... G03C 7/392

[52] U.S. Cl. ..... 430/551; 430/556; 430/557

[58] Field of Search ..... 430/551, 609, 610, 613, 430/556, 557

[56] References Cited

U.S. PATENT DOCUMENTS

| | | | |
|---|---|---|---|
| 2,816,028 | 12/1957 | Minsk | 430/551 |
| 4,717,651 | 1/1988 | Ohki et al. | 430/551 |
| 4,943,519 | 7/1990 | Helling et al. | 430/609 |
| 5,310,643 | 5/1994 | Helling et al. | 430/551 |

FOREIGN PATENT DOCUMENTS

| | | | |
|---|---|---|---|
| 0542053 | 5/1993 | European Pat. Off. . | |
| 0586974 | 3/1994 | European Pat. Off. . | |
| 1137247 | 5/1989 | Japan | 430/551 |

*Primary Examiner*—Lee C. Wright
*Attorney, Agent, or Firm*—Connolly & Hutz

[57] ABSTRACT

A color photographic recording material with at least one silver halide emulsion layer and a color coupler associated with that layer, which contains in the silver halide emulsion layer or in an adjacent non-photosensitive binder layer a combination of a color coupler and a compound corresponding to general formula (I) or (II):

(I)

in which $R_4$ is the residue of a polymer produced by polycondensation and $R_1$ to $R_3$, m and n are as defined in the specification, (II)

in which $R_4$ is as defined above and $L_1$, $L_2$, X, $R_5$ to $R_{11}$, p, q and r are as defined in the specification, is distinguished by improved stability of the image dyes produced from yellow couplers.

11 Claims, No Drawings

COLOR PHOTOGRAPHIC RECORDING MATERIAL

This invention relates to a photographic recording material with at least one silver halide emulsion layer which contains new light stabilizers for the image dyes produced during chromogenic development, more particularly for yellow azomethine dyes.

It is known that colored photographic images can be produced by chromogenic development, i.e. by developing suitable color couplers using suitable dye-producing developer substances, so-called color developers, the developer oxidation product formed in accordance with the silver image reacting with the color coupler to form a dye image. The color developers used are normally aromatic compounds containing primary amino groups, more particularly of the p-phenylenediamine type.

These dyes are required to show high color stability, particular emphasis being placed on equally good color stability of all three colors so that no color falsification occurs in the event of slight fading.

The problem addressed by the present invention was to provide new light stabilizers for photographic recording materials, more particularly light stabilizers which would be suitable for improving the light stability of the yellow image dyes produced from yellow couplers.

The present invention relates to a color photographic recording material comprising at least one silver halide emulsion layer and a color coupler associated with that layer, characterized in that, in the silver halide emulsion layer or in a non-photosensitive binder layer adjacent thereto, it contains a combination of a color coupler and a compound corresponding to general formula (I) or (II):

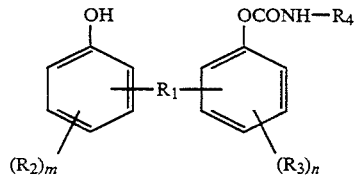

(I)

in which $R_1$ is a chemical bond or a difunctional bridge member, $R_2$ and $R_3$ are alkyl, alkoxy, alkenyl, cycloalkyl, aryl or aryloxy or two substituents $R_2$ and $R_3$ represent the remaining atoms of a benzene ring condensed with the phenyl group, m and n=0 to 3, all the alkyl, alkoxy, cycloalkyl, alkenyl, aryl and aryloxy radicals lending themselves to further substitution and one of the substituents $R_1$ or $R_2$ or $R_3$ in each of the two phenyl rings corresponding to formula (I) being in the p-position to the oxygen and $R_4$ is the residue of a polymer produced by polycondensation, more particularly a polyester, polyether, polycarbonate, polyurethane or polyester polyurethane,

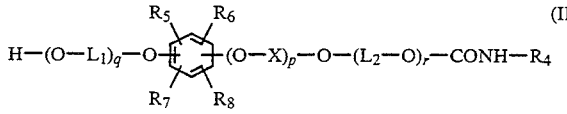

(II)

in which $L_1$ and $L_2$ represent an optionally substituted, difunctional organic radical attached to the oxygen atoms by aliphatic or aromatic carbon atoms, X is an optionally substituted difunctional organic radical attached to the oxygen atoms by aliphatic or aromatic carbon atoms, p=0, 1 q, r=0–20, preferably 0–3, $R_5$, $R_6$, $R_7$ and $R_8$ represent H, alkyl (linear, branched, cyclic, unsubstituted or substituted), aryl, acyl, aralkyl, alkylamino, arylamino, halogen, alkoxy, aryloxy, $—S_2—NR_9R_{10}$, $—NR_9—SO_2—R_{10}$, $—CONR_9R_{10}$, $—NR_9COR_{11}$, $—OCOR_{10}$, $—COOR_9$, $R_9$ represents H, alkyl, $R_{10}$ represents H, alkyl, aralkyl, aryl, $R_{11}$ represents alkoxy, aroxy, alkylamino, arylamino or has the same meaning as $R_5$, X may even form a 5- or 6-membered ring with $R_5$, $R_6$, $R_7$ or $R_8$ and $R_4$ is as defined above.

$L_1$ and $L_2$ are preferably optionally substituted $C_{2-8}$ and preferably $C_{2-4}$ alkylene chains while n and m have values of 1 to 20, preferably 1 to 5 and, more preferably, 1 to 3.

Suitable bridge members $R_1$ are, for example, alkylene, cycloalkylene, alkylidene or sulfonyl groups and also hetero atoms, such as O and S. Examples of $R_2$ and $R_3$ are methyl, ethyl, propyl, n-butyl, t-butyl, sec.butyl, cyclohexyl, dodecyl, hexadecyl and benzyl.

Preferred compounds (II) correspond to the following formulae:

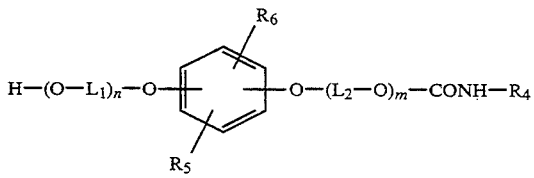

II-A

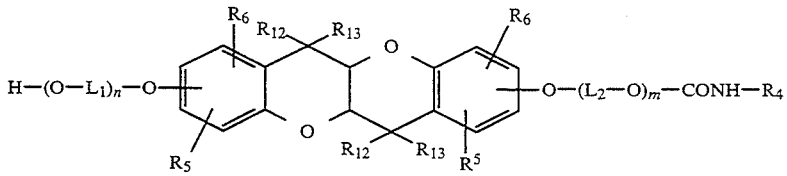

II-B

-continued

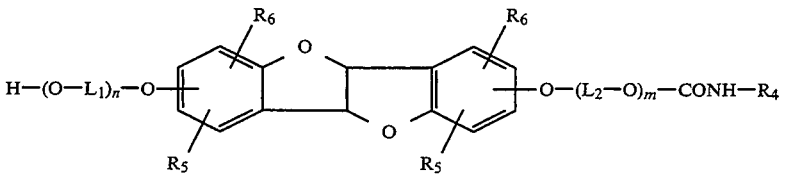

II-C in which $R_{12}$ and $R_{13}$ represent H or alkyl.

$L_1$ and $L_2$ in formula (II) are preferably optionally substituted $C_{2-8}$ and preferably $C_{2-4}$ alkylene chains while n and m assume a value of 0 to 20, preferably 1 to 5 and more preferably 1 to 3.

In other preferred embodiments, $R_5$ and $R_6$ in formulae II-A to II-C having the following meanings: H, alkyl, aryl, acyl, sulfonylamino, acylamino, ureido, alkoxy, alkoxycarbonylamino.

The following are suitable starting compounds for compounds corresponding to formulae (I) and (II), in which $R_4$ is H:

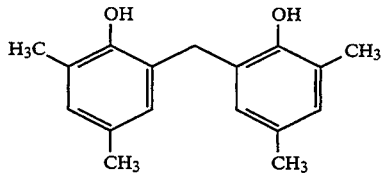

III-1

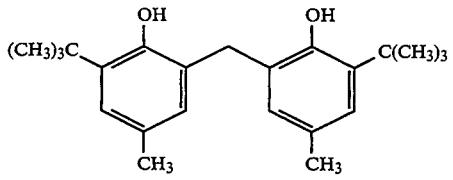

III-2

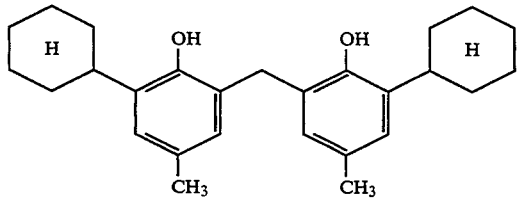

III-3

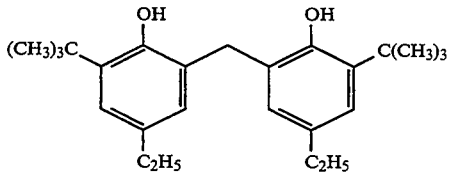

III-4

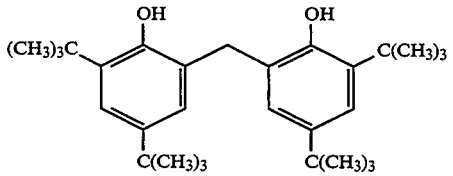

III-5

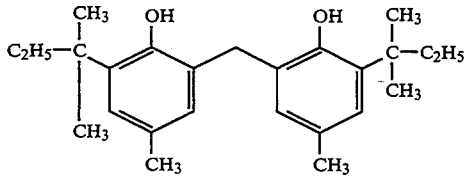

III-6

-continued
III-7
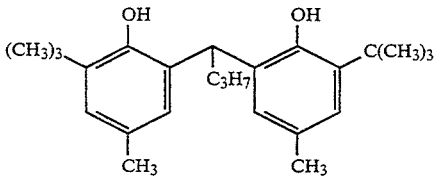
III-8
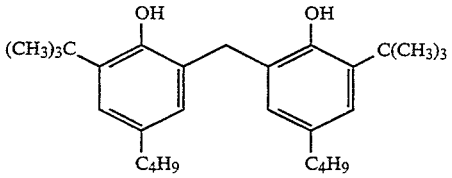
III-9
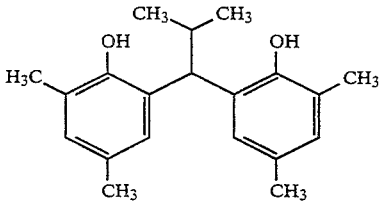
III-10
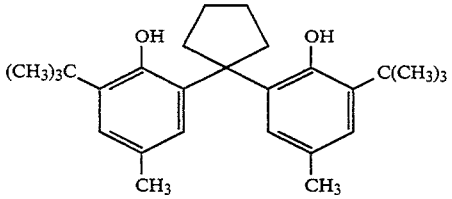
III-11
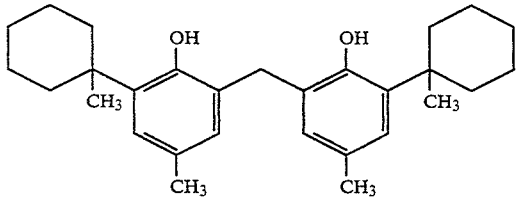
III-12
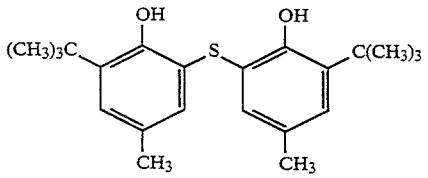
III-13
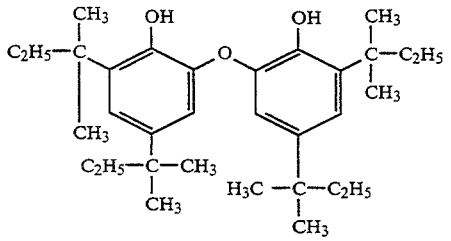
III-14
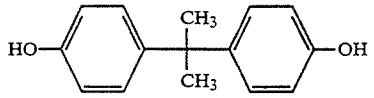

-continued
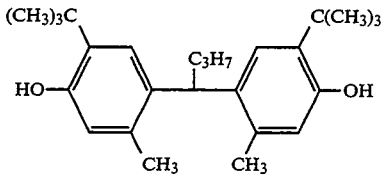
III-15
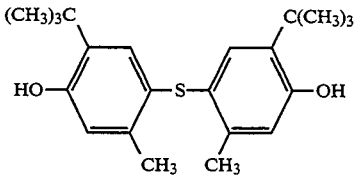
III-16
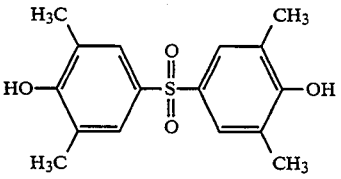
III-17
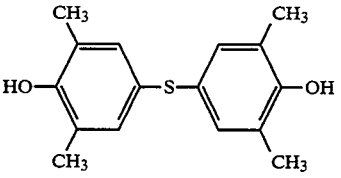
III-18
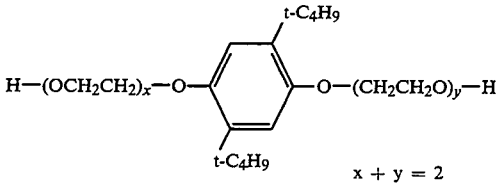
x + y = 2
IV-1
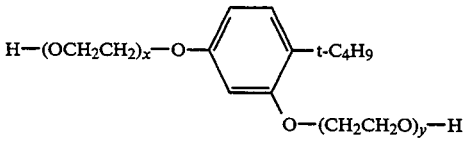
x + y = 2, 1
IV-2
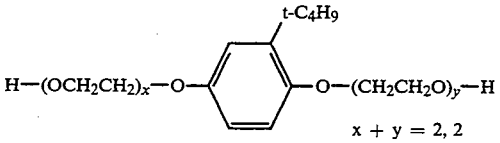
x + y = 2, 2
IV-3
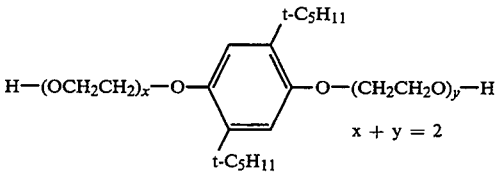
x + y = 2
IV-4
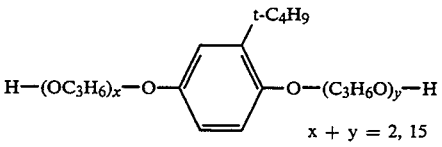
x + y = 2, 15
IV-5

-continued
IV-6
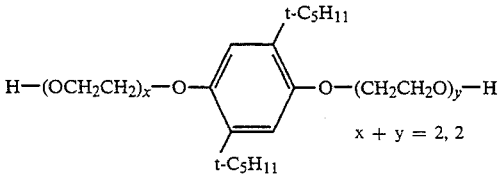
x + y = 2, 2
IV-7
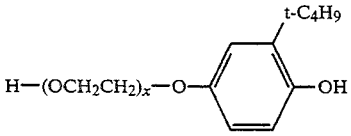
x = 1
IV-8
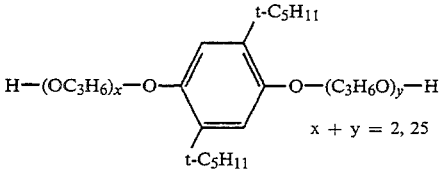
x + y = 2, 25
IV-9
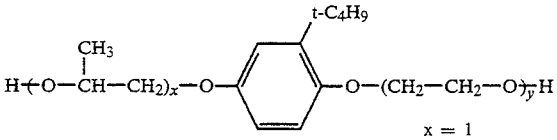
x = 1
y = 1, 2
IV-10
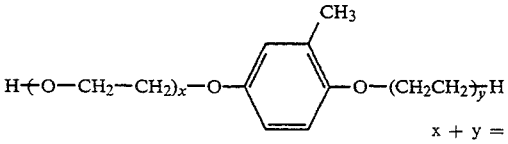
x + y = 2, 1
IV-11
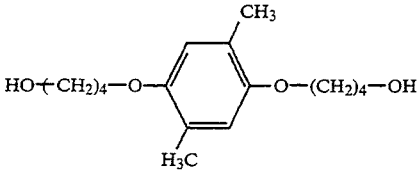
IV-12
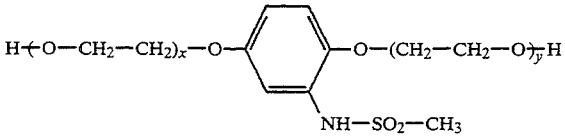
x + y = 2, 2
IV-13
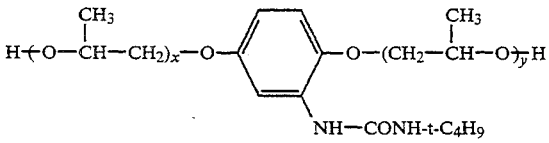
x + y = 2, 1
IV-14
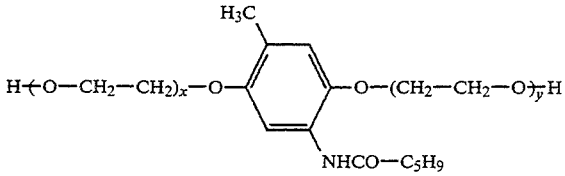
x + y = 2, 15

-continued

IV-15

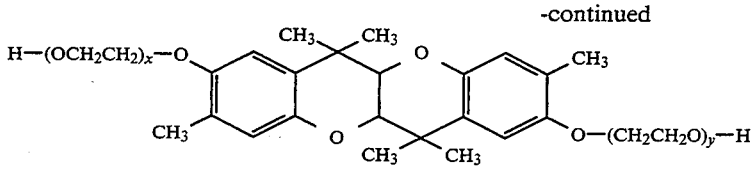

x + y = 2

IV-16

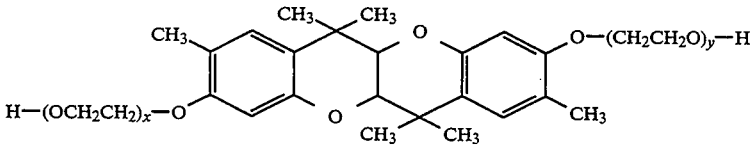

x + y = 2, 2

IV-17

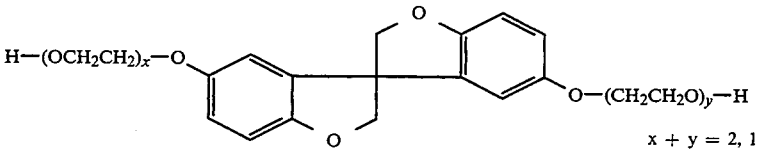

x + y = 2, 1

The following are examples of stabilizers according to the invention:

I-1: Compound III-9 attached to an equimolar quantity of —CONH—$(CH_2)_6$—NHCOO—$R_4$
$R_4$=polyester of glutaric acid and butanediol I-2: Compound III-2 attached to an equimolar quantity of —CONH—$(CH_2)_6$—NHCOO—$R_4$
$R_4$=polyester of adipic acid and butanediol I-3: Compound III-4 attached to an equimolar quantity of

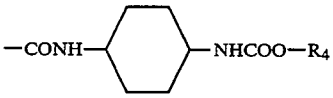

$R_4$=polyester of succinic acid and butanediol

I-4: Compound III-2 attached to an equimolar quantity of —CONH—$(CH_2)_6$—NHCOO—$R_4$
$R_4$=polyester of phthalic acid and adipic acid in a ratio by weight of 3:7 and ethylene glycol I-5: Compound III-15 attached to an equimolar quantity of

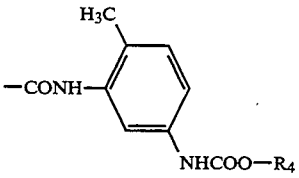

$R_4$=polypropylene oxide

I-6: Compound III-18 attached to an equimolar quantity of —CONH—$(CH_2)_6$—NHCO—$R_4$
$R_4$=polyester of adipic acid and propanediol I-7: Compound III-3 attached to an equimolar quantity of

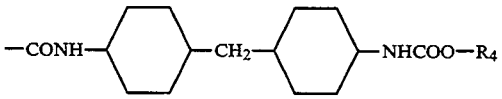

$R_4$=polyester of adipic acid and a mixture of butanediol/neopentyl glycol in a ratio by weight of 1:1

-8: Compound III-12 attached to an equimolar quantity of —CONH—$(CH_2)_6$—NHCOO—$R_4$
$R_4$=polycaprolactone I-9: Compound III-17 attached to an equimolar quantity of

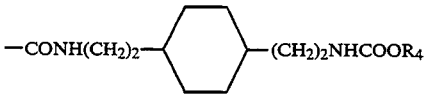

$R_4$=polyester of maleic acid and butanediol

I-10: Compound III-2 attached to an equimolar quantity of —CONH—$(CH_2)_4$—NHCOO—$R_4$
$R_4$=polyester of adipic acid and neopentyl glycol I-11: Compound III-10 attached to an equimolar quantity of

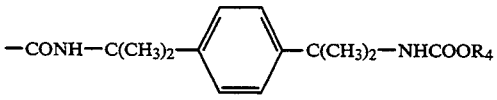

$R_4$=polyester of adipic acid, neopentyl glycol and ethylene glycol

II-12: Compound IV-3 attached to an equimolar quantity of —CONH—$(CH_2)_6$—NHCOO—$R_4$
$R_4$=polyester of adipic acid and butanediol II-13: Compound IV-8 attached to an equimolar quantity of —CONH—$(CH_2)_4$—NHCOO—$R_4$
$R_4$=polyester of adipic acid and terephthalic acid (1:1 parts by weight) and butanediol II-14: Compound IV-6 attached to an equimolar quantity of —CONH—$(CH_2)_6$—NHCOO—$R_4$
$R_4$=polyester of adipic acid and butanediol II-15: Compound IV-14 attached to an equimolar quantity of

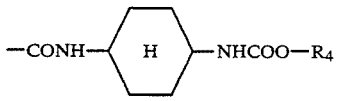

$R_4$=polyester of adipic acid and neopentyl glycol-/ethylene glycol in ratio by weight of 1:1

II-16: Compound IV-16 attached to an equimolar quantity of —CONH—$(CH_2)_6$—NHCOO—$R_4$
$R_4$=polyester of adipic acid and butanediol II-17: Compound IV-7 attached to an equimolar quantity of —CONH—$(CH_2)_6$—NHCOO—$R_4$
$R_4$=polyester of adipic acid and butanediol The compounds corresponding to formulae (I) and (II) are preferably used in a quantity of 0.1 to 2 mol per mol of the coupler with which they are combined.

The compounds according to the invention may readily be prepared by reaction of OH-functional compounds corresponding to formula III or IV (starting compound 1) with polymeric mono-, di- or polyisocyanates (starting compound 2).

Suitable polymeric isocyanates (hereinafter referred to as NCO prepolymers) are polymers containing isocyanate groups which are obtained by reaction of compounds containing active hydrogen atoms and diisocyanates or polyisocyanates. The compounds containing active hydrogen atoms are substantially linear and have a molecular weight in the range from about 300 to 10,000 and preferably in the range from 500 to 4,000. The compounds known per se are terminated by hydroxyl and/or amino groups. Polyhydroxyl compounds, such as polyesters, polyacetals, polyethers, polyamides, polyesteramides and polycarbonates, are preferred. Accordingly, these compounds have a hydroxyl value of about 370 to 10 and, more particularly, in the range from 225 to 28.

Suitable polyethers are, for example, the polymerization products of ethylene oxide, propylene oxide, tetrahydrofuran, butylene oxide and copolymerization or graft polymerization products thereof, the condensates obtained by condensation of polyhydric alcohols or mixtures thereof and the products obtained by alkoxylation of polyhydric alcohols.

Suitable polyacetals are, for example, the compounds obtainable from hexanediol and formaldehyde. Suitable polyesters, polyesteramides and polyamides are the predominantly linear condensates obtained from polybasic, saturated or unsaturated carboxylic acids and polyhydric saturated alcohols, aminoalcohols, diamines and mixtures thereof.

Polyhydroxyl compounds already containing urethane or urea groups may also be used.

Mixtures of various polyhydroxyl compounds may of course be used to vary the lyophilicity and hydrophobicity and also the mechanical properties of the end products.

Suitable polyisocyanates for the production of the polymers containing NCO groups are any aromatic and aliphatic diisocyanates or triisocyanates, such as for example 1,5-naphthylene diisocyanate, 4,4'-diphenyldiisocyanate, di- and tetraalkyl diphenylmethane diisocyanate, 4,4'-dibenzyl diisocyanate, 1,3-phenylene diisocyanate, 1,4-phenylene diisocyanate, the isomers of tolylene diisocyanate, optionally in admixture, preferably the aliphatic diisocyanates, 1,4-butane diisocyanate, 1,6-hexane diisocyanate, dicyclohexyl methane diisocyanate, cyclohexane-1,4-diisocyanate and also isophorone diisocyanate, biuret triisocyanate, 2,4-bis-(4-isocyanatobenzyl)-1-isocyanatobenzene, tris-(4-isocyanatophenyl)-methane, 2-ethyl-1,2,3-tris-(3-isocyanato-4-methyl-anilinocarbonyloxy)-propane.

The NCO prepolymers may be produced by the methods mentioned in Houben-Weyl, Vol. 205, pages 1613 et seq. (Georg Thieme Verlag, Stuttgart/N.Y., 1987).

The NCO prepolymers or rather the polymers produced by polycondensation, of which the residue is represented by $R_4$, preferably contain in their chain urethane groups and/or urea groups which have been formed in the reaction of the compounds containing active hydrogen atoms with polyisocyanates.

Preparation of compound I-2

136 g of an NCO prepolymer with an NCO content of 0.1 mol, which has been obtained from polyester diols of adipic acid and butane-1,4-diol by reaction with hexamethylene diisocyanate, are dissolved in 250 ml of acetone and 34 g of compound I-2 are added with stirring to the resulting solution. After stirring for 6 hours at 50° C., the acetone is distilled off in a rotary evaporator and the residue is dissolved in ethyl acetate, extracted by shaking with water and dried with $Na_2SO_4$. A clear viscous solution with a solids content of 40% by weight is obtained.

Yield: 88%.

Compounds I-1 and I-3 to I-11 and II-12 to II-17 are similarly obtained from the corresponding starting compounds and an NCO prepolymer.

The compounds are preferably used in a quantity of 0.1 to 4 g/g of color coupler and more particularly in a quantity of 0.4 to 1 g/g of color coupler. The compounds may be used in combination with other dye stabilizers.

The color photographic recording material according to the invention contains at least one photosensitive silver halide emulsion layer and preferably a sequence of several such photosensitive silver halide emulsion layers and optionally other auxiliary layers, such as in particular protective layers and non-photosensitive binder layers arranged between the photosensitive layers, a compound according to the invention in combination with a color coupler, preferably a yellow coupler, being associated in accordance with the present invention with at least one of the photosensitive silver halide emulsion layers present.

The compounds according to the invention act primarily as light stabilizers, i.e. the dyes formed from the color coupler during chromogenic development, generally azomethine dyes, show considerably increased stability to light in the presence of the compounds according to the invention. The compounds according to the invention also improve the stability of the dye to the effects of heat and moisture. In addition, the compounds according to the invention also act as an oil former for the color coupler, i.e. they may be used as coupler solvents either on their own or in conjunction with other known oil formers. In the latter case, the compounds according to the invention preferably make up at least 50% by weight of the total quantity of oil former in the particular layer. The fact that no other oil formers are necessary has a favorable effect on the layer loading and/or the overall layer thickness of the recording materials according to the invention.

In their production (reaction of the compounds containing active hydrogen atoms with polyisocyanates), the compounds according to the invention generally accumulate in the form of a solution in aprotic (hydrophobic) solvents, for example ethyl acetate, and may be directly used in the form of this solution for incorporation into the casting solution for the particular layer, optionally together with the particular color coupler. The solution is incorporated in the usual way, optionally using other auxiliary solvents and/or high-boiling coupler solvents, so-called oil formers (preferably in small quantities only).

Examples of color photographic materials are color negative films, color reversal films, color positive films, color photographic paper, color reversal photographic paper, dye-sensitive materials for the dye diffusion transfer process or the silver dye bleaching process.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or $\alpha$-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

The color photographic materials normally contain at least one red-sensitive, at least one green-sensitive and at least one blue-sensitive silver halide emulsion layer and, optionally, interlayers and protective layers.

Key components of the photographic emulsion layers are binders, silver halide crystals and color couplers.

Gelatine is preferably used as binder. However, it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine). Gelatines of high viscosity and low swelling are particularly advantageous.

The silver halide present as photosensitive constituent in the photographic material may contain as halide chloride, bromide or iodide and mixtures thereof. For example, 0 to 15 mol-% of the halide of at least one layer may consist of iodide, 0 to 100 mol-% of chloride and 0 to 100 mol-% of bromide. Silver bromide iodide emulsions are normally used in the case of color negative and color reversal films while silver chloride bromide emulsions of high chloride content up to pure silver chloride emulsions are normally used in the case of color negative and color reversal paper. The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 5:1, the diameter of a crystal being defined as the diameter of a circle with an area corresponding to the projected area of the crystal. AgBrCl emulsions containing at least 80 mol-% of AgCl and, more particularly, at least 95 mol-% of AgCl are preferably used.

The silver halide grains may also have a multiple-layer grain structure, in the most simple case with an inner and an outer core region (core/shell), the halide composition and/or other modifications such as, for example, doping of the individual grain regions, being different. The average grain size of the emulsions is preferably between 0.2 $\mu$m and 2.0 $\mu$m; the grain size distribution may be both homodisperse and heterodisperse. A homodisperse grain size distribution means that 95% of the grains differ from the average grain size by no more than $\pm$30%. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al, Making and Coating Photographic Emulsion, The Focal Press, London (1966)).

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizer concentration) until sensitivity and fogging are both optimal. The process is described, for example, in H. Frieser "Die Grundlagen der Photographischen Prozesse mit Silberhalogeniden" pages 675–734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964 and in Ullmanns Encyclopädie der technischen Chemie, 4th Edition, Vol. 18, pages 431 et seq and Research Disclosure No. 17643 (December 1978), Chapter III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage and photographic processing.

Particularly suitable compounds of this type are azaindenes, preferably tetra- and pentaazindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure 17643 (December 1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfur or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643 (December 1978), Chapter IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia- or selenocarbocyanines and 9-ethyl naphthothiaoxa- and benzimidazocarbocyanines, providing the dye contains at least one sulfoalkyl group at the heterocyclic nitrogen;

2. as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

There is no need for sensitizers where the natural sensitivity of the silver halide is sufficient for a certain spectral region, for example the blue sensitivity of silver bromides.

Non-diffusing monomeric or polymeric color couplers are associated with the differently sensitized emulsion layers and may be arranged in the same layer or in an adjacent layer. Cyan couplers are normally associated with the red-sensitive layers, magenta couplers with the green-sensitive layers and yellow couplers with the blue-sensitive layers.

Color couplers for producing the cyan dye image are generally couplers of the phenol or α-naphthol type. Color couplers for producing the magenta dye image are generally couplers of the 5-pyrazolone type, the indazolone type or the pyrazoloazole type. Color couplers for producing the yellow dye image are generally couplers containing an open-chain ketomethylene group, more especially couplers of the α-acyl acetamide type, for example α-pivaloyl acetanilide couplers.

Preferred yellow couplers are 2-equivalent-α-pivaloyl acetanilide couplers of which the leaving group is attached to the coupling position by oxygen or nitrogen.

The following are examples of suitable yellow couplers:

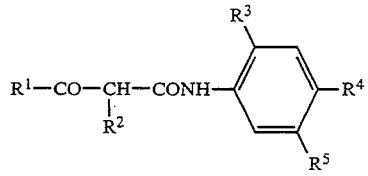

Y-1: $R^1 = -C_4H_9$-t;

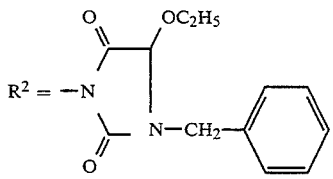

-continued $R^3$ = Cl; $R^4$ = H;

$R^5$ = 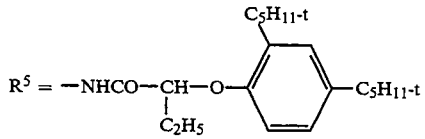

Y-2: $R^1$ = $-C_4H_9$-t;

$R^2$ = 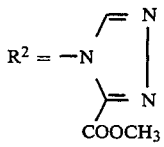

$R^3$ = $-OC_{16}H_{33}$; $R^4$ = H; $R^5$ = $-SO_2NHCH_3$

Y-3: $R^1$ = $-C_4H_9$-t;

$R^2$ = 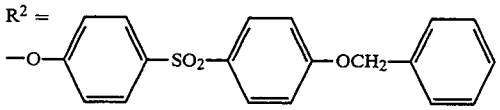

$R^3$ = Cl; $R^4$ = H; $R^5$ = $-NHSO_2-C_{16}H_{33}$

Y-4: $R^1$ = $-C_4H_9$-t;

$R^2$ = 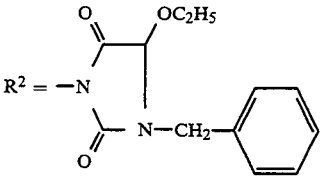

$R^3$ = Cl; $R^4$ = H; $R^5$ = $-COOC_{12}H_{25}$

Y-5: $R^1$ = $-C_4H_9$-t;

$R^2$ = 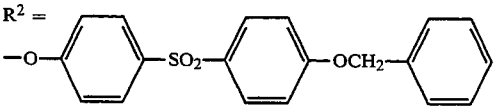

$R^3$ = Cl; $R^4$ = H;

$R^5$ = 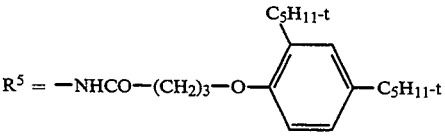

Y-6: $R^1$ = $-C_4H_9$-t;

$R^2$ = 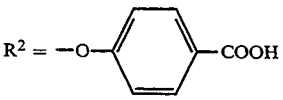

$R^3$ = Cl; $R^4$ = ;

$R^5$ = 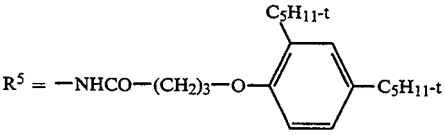

Y-7: $R^1$ = $-C_4H_9$-t;

-continued $R^2$ = 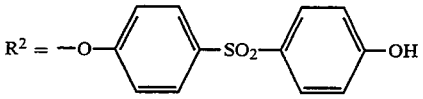

$R^3$ = Cl; $R^4$ = H; $R^5$ = $-NHSO_2-C_{16}H_{33}$

Y-8: $R^1$ = $-C_4H_9$-t;

$R^2$ = 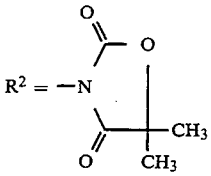

$R^3$ = Cl; $R^4$ = H;

$R^5$ = 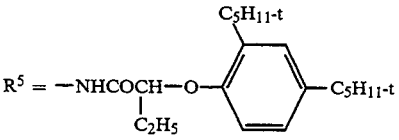

Y-9: $R^1$ = $-C_4H_9$-t;

$R^2$ = 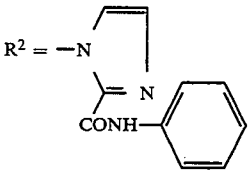

$R^3$ = $-OC_{16}H_{33}$; $R^4$ = H; $R^5$ = $-SO_2NHCOC_2H_5$

Y-10: $R^1$ = $-C_4H_9$-t;

$R^2$ = 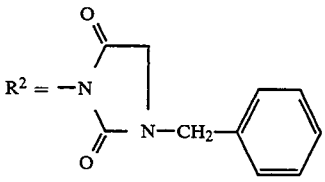

$R^3$ = $-$Cl; $R^4$ = H;

$R^5$ = 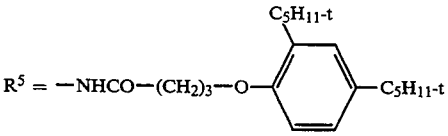

Y-11: $R^1$ = $-C_4H_9$-t;

$R^2$ = 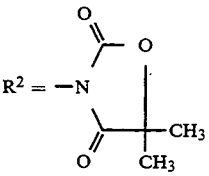

$R^3$ = Cl; $R^4$ = H;

$R^5$ = $-COOCH-COOC_{12}H_{25}$
$\quad\quad\quad

-continued
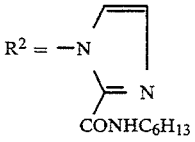
$R^3$ = Cl; $R^4$ = H;
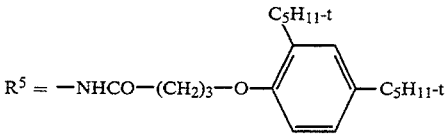
Y-13: $R^1$ = $-C_4H_9$-t;
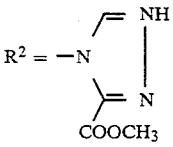
$R^3$ = $-OC_{16}H_{33}$; $R^4$ = H; $R^5$ = $-SO_2NHCH_3$
Y-14: $R^1$ = $-C_4H_9$-t;
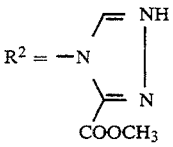
$R^3$ = —Cl; $R^4$ = H;
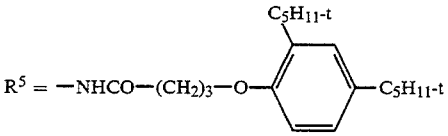
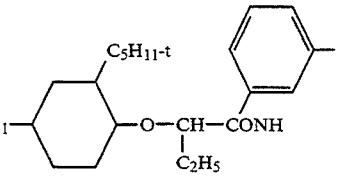
Y-15: $R^1$ = t-$C_5H_{11}$—
$R^2$, $R^4$, $R^5$ = H $R^3$ = $-OCH_3$
Y-16: $R^1$ = —
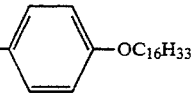
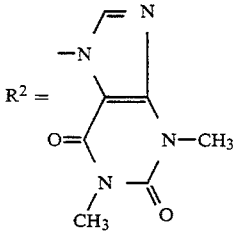
$R^3$, $R^5$ = $-OCH_3$; $R^4$ = H;
-continued
Y-17: $R^1$ = —
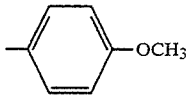
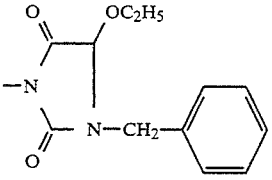
$R^3$ = Cl; $R^4$ = H; $R^5$ = $-COOC_{12}H_{25}$;
Y-18: $R^1$ = —
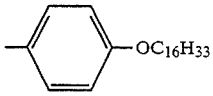
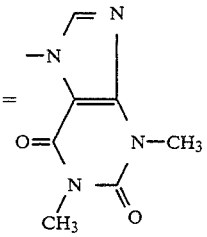
$R^3$ = Cl; $R^4$, $R^5$ = $-OCH_3$;
Y-19: $R^1$ = —
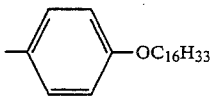
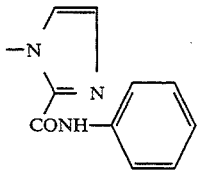
$R^3$ = $-OCH_3$; $R^4$ = H; $R^5$ = $-SO_2N(CH_3)_2$;
Y-20: $R^1$ = —
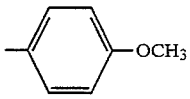
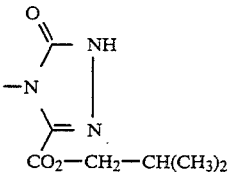
$R^3$ = $-OCH_3$; $R^4$ = H;
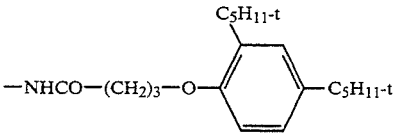
Y-21: $R^1$ = $-C_4H_9$-t;

-continued

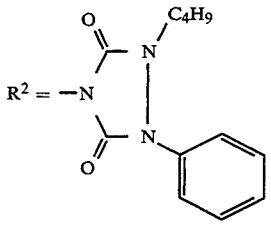

$R^3 = -OCH_3$; $R^4 = H$;

$R^5 = -NHCOCH(CH_3)-CH_2-SO_2-C_{12}H_{25}$

Y-22:

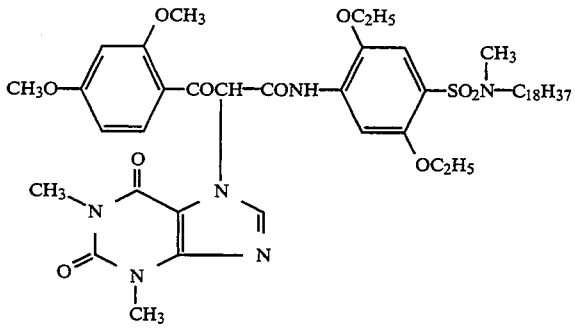

Y-23:

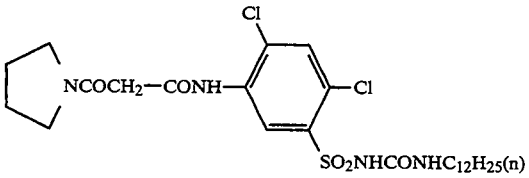

Y-24:

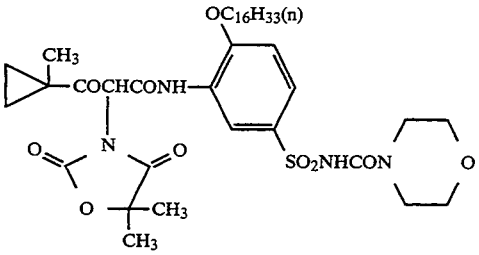

Y-25:

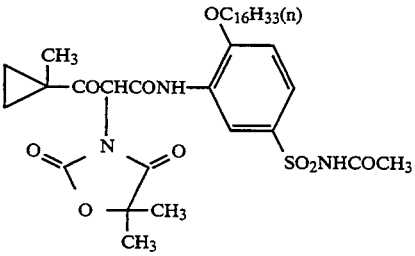

Y-26:

-continued

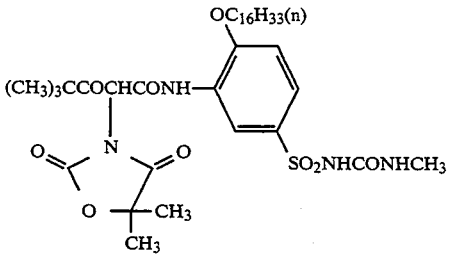

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such as these are the known DIR couplers and also DAR and FAR couplers.

DIR couplers containing development inhibitors of the azole type, for example triazoles and benzotriazoles, are described in DE-A-24 14 006, 26 10 546, 26 59 417, 27 54 281, 28 42 063, 36 26 219, 36 30 564, 36 36 824, 36 44 416. Further advantages in regard to color reproduction, i.e. color separation and color purity, and in regard to detail reproduction, i.e. sharpness and graininess, can be obtained with DIR couplers which, for example, do not release the development inhibitor as the direct result of coupling with an oxidized color developer, but only after a further reaction, for example with a timing group. Examples of DIR couplers such as these can be found in DE-A-28 55 697, 32 99 671, 38 18 231, 35 18 797, in EP-A-0 157 146 and 0 204 175, in U.S. Pat. Nos. 4,146,396 and 4,438,393 and in GB-A-2,072,363.

DIR couplers releasing a development inhibitor which is decomposed in the developer bath to photographically substantially inactive products are described, for example, in DE-A-3 209 486 and in EP-A-0 167 168 and 0 219 713. Problem-free development and stable processing are achieved by this measure.

Where DIR couplers, particularly those releasing a readily diffusible development inhibitor, are used, improvements in color reproduction, for example a more differentiated color reproduction, can be obtained by suitable measures during optical sensitization, as described for example in EP-A-0 115 304, 0 167 173, GB-A-2,165,058, DE-A-37 00 419 and U.S. Pat. No. 4,707,436.

In a multilayer photographic material, the DIR couplers may be added to various layers, including for example even non-photosensitive layers or interlayers. However, they are preferably added to the photosensitive silver halide emulsion layers, the characteristic properties of the silver halide emulsion, for example its iodide content, the structure of the silver halide grains or their grain size distribution, influencing the photographic properties obtained. The effect of the inhibitors released may be limited, for example by the incorporation of an inhibitor-trapping layer according to DE-A-24 31 223. For reasons of reactivity or stability, it may be of advantage to use a DIR coupler which, in the particular layer into which it is introduced, forms a color differing from the color to be produced in that layer during the coupling reaction.

To increase sensitivity, contrast and maximum density, it is possible to use above all DAR or FAR couplers which release a development accelerator or a fogging agent. Compounds of this type are described, for example, in DE-A-25 34 466, 32 09 110, 33 33 355, 34 10 616, 34 29 545, 34 41 823, in EP-A-0 089 834, 0 110 511, 0 118 087, 0 147 765 and in U.S. Pat. Nos. 4,618,572 and 4,656,123.

An example of the use of BAR (bleach accelerator releasing) couplers can be found in EP-A-193 389.

It can be of advantage to modify the effect of a photographically active group released from the coupler by an intermolecular reaction between this group after its release and another group in accordance with DE-A-35 06 805.

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A-15 47 640).

The releasable group may also be a ballast group so that coupling products which are diffusible or at least show slight or limited mobility are obtained in the reaction with color developer oxidation products (U.S. Pat. No. 4,420,556).

The material may also contain compounds different from couplers which may release, for example, a development inhibitor, a development accelerator, a bleach accelerator, a developer, a silver halide solvent, a fogging agent or an anti-fogging agent, for example so-called DIR hydroquinones and other compounds of the type described, for example, in U.S. Pat. Nos. 4,636,546, 4,345,024, 4,684,604 and in DE-A-31 45 640, 25 15 213, 24 47 079 and in EP-A-198 438. These compounds perform the same function as the DIR, DAR or FAR couplers except that they do not form coupling products.

High molecular weight couplers are described, for example, in DE-C-1 297 417, DE-A-24 07 569, DE-A-31 48 125, DE,A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. Nos. 2,322,027, 2,801,170, 2,801,171 and EP-A-0 043 037.

Instead of using high-boiling solvents, it is also possible to use oligomers or polymers, so-called polymeric oil formers. The compounds according to the invention are used in particular for the yellow-coupling layer.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Each of the differently sensitized photosensitive layers may consist of a single layer or may even comprise two or more silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Providing the natural sensitivity of the green-sensitive or red-sensitive layers is suitably low, it is possible to select other layer arrangements without the yellow filter layer, in which for example the blue-sensitive layers, then the red-sensitive layers and finally the green-sensitive layers follow one another on the support.

The non-photosensitive interlayers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (December 1978), Chapter VII, 17 842 (February 1979) and 18 716 (November 1979) page 650 and in EP-A-0 069 070, 0 098 072, 0 124 877, 0 125 522.

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure 17 643, (December 1978), Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643 (December 1978), Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment of magenta-red dye images, particularly their impairment as a result of the effect of light.

The following are examples of particularly suitable compounds:

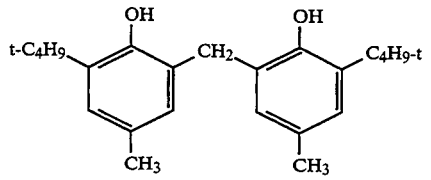

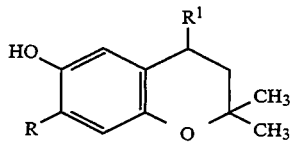

R = —C8H17-t; R1 = —CH3
R = —C8H17; R1 = —C3H7-i

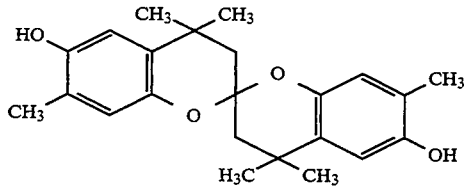

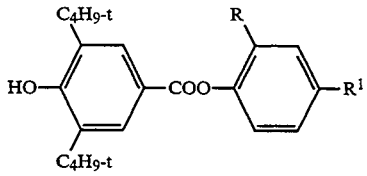

R, R1 = —C4H9-t
R, R1 = —C5H11-t

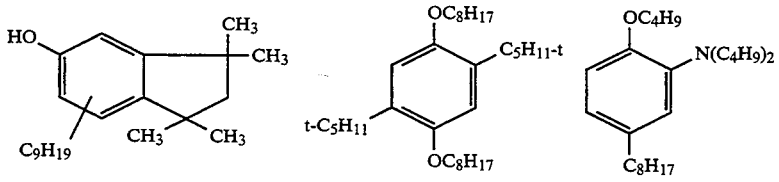

-continued

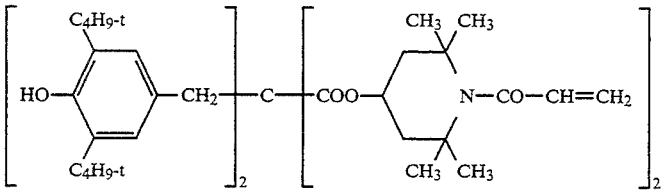

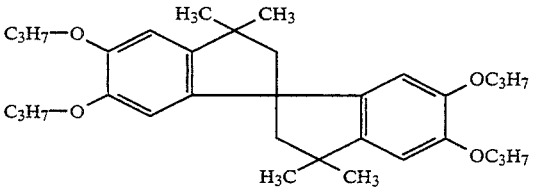

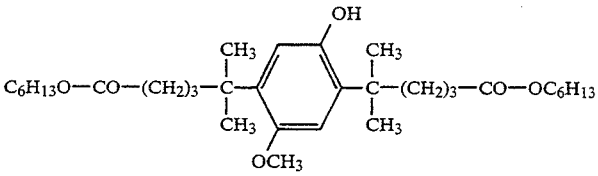

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

EXAMPLES

Example 1

The following two layers were applied to a paper coated with polyethylene on both sides. The quantities shown are based on one square meter.

Sample 1 (Comparison):

1st layer

Blue-sensitive silver halide emulsion layer of 0.6 g of $AgNO_a$ (99.5 mol-% of chloride, 0.5 mol-% of bromide, mean particle diameter 0.78 μm)

2 g of gelatine 0.8 g of yellow coupler Y-9

0.6 g of tricresyl phosphate (TCP)

2nd layer 2 g of gelatine 0.4 g of hardener corresponding to the following formula:

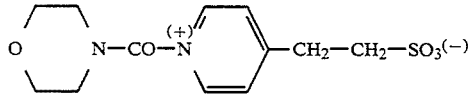

Samples 2 to 5 (according to the invention)

Samples 2 to 5 were prepared in the same way as sample 1 except that the TCP used in sample 1 was replaced by the same quantity of one of the compounds according to the invention as shown in Table 1.

The samples were then exposed behind a graduated grey wedge, after which the materials were processed in the usual way in the following processing baths:

| | |
|---|---|
| a) Color developer - 45 s - 35° C. | |
| Triethanolamine | 9.0 g/l |
| N,N-diethyl hydroxylamine | 4.0 g/l |
| Diethylene glycol | 10.05 g/l |
| 3-Methyl-4-amino-N-ethyl-N-methane-sulfonamidoethyl aniline sulfate | 5.0 g/l |
| Potassium sulfite | 0.2 g/l |
| Triethylene glycol | 0.05 g/l |
| Potassium carbonate | 22 g/l |
| Potassium hydroxide | 0.4 g/l |
| Ethylenediamine tetraacetic acid disodium salt | 2.2 g/l |
| Potassium chloride | 2.5 g/l |
| 1,2-Dihydroxybenzene-3,4,6-trisulfonic acid trisodium salt | 0.3 g/l |
| Make up with water to 1,000 ml; pH 10.0 | |
| b) Bleaching/fixing bath - 45 s - 35° C. | |
| Ammonium thiosulfate | 75 g/l |
| Sodium hydrogen sulfite | 13.5 g/l |
| Ammonium acetate | 2.0 g/l |
| Ethylenediamine tetraacetic acid (iron ammonium salt) | 57 g/l |
| Ammonia, 25% by weight | 9.5 g/l |
| Acetic acid | 9.0 g/l |
| Make up with water to 1,000 ml; pH 5.5 | |

c) Washing—2 mins.—35° C.

d) Drying

The processed samples covered with a UV-absorbing protective film are then irradiated ($20 \cdot 10^6$ lxh) in a xenotester to determine their fastness to light.

The UV barrier film had been produced as follows: a layer of 1.5 g of gelatine, 0.65 g of compound A (UV absorber) corresponding to the following formula:

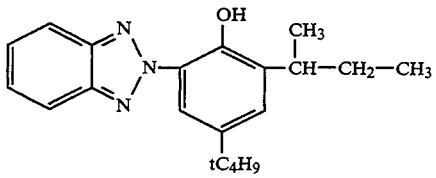

0.07 g of dioctyl hydroquinone and 0.36 g of tricresyl phosphate was applied to a transparent cellulose triacetate film coated with an adhesive layer. The quantities are based on 1 square meter,

TABLE 1

| Sample | | Oil former/ polymer | Reduction in density in % at density 1.0 | $D_{max}$ |
|---|---|---|---|---|
| 1 | Comparison | TCP | 40 | 65 |
| 2 | Invention | II-14 | 23 | 43 |
| 3 | Invention | I-2 | 17 | 30 |
| 4 | Invention | I-1 | 18 | 29 |
| 5 | Invention | II-17 | 20 | 41 |

Table 1 shows that the light stability of the dye is distinctly improved by the compound according to the invention.

Example 2

Example 1 was repeated with the difference that yellow coupler Y-9 was replaced by the same quantity of yellow coupler Y-21.

In a comparison sample, the compound according to the invention was replaced by the same quantity of comparison compound P-1:

P-1:

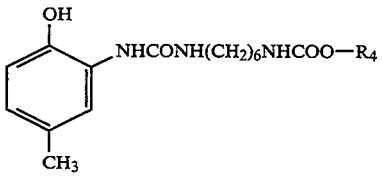

$R_4$=polyester of adipic acid and butanediol

The processed samples were subjected to a xenotest as described in Example 1. The results are set out in Table 2.

After processing, the material was stored in a conditioning cabinet (24 days at 80° C./50% relative humidity). The results are set out in Table 3.

TABLE 2

| Sample | | Oil former/ polymer | Reduction in density in % at density 1.0 | $D_{max}$ |
|---|---|---|---|---|
| 6 | Comparison | TCP | 36 | 63 |
| 7 | Invention | II-14 | 22 | 45 |
| 8 | Invention | I-2 | 18 | 31 |
| 9 | Invention | I-1 | 19 | 28 |
| 10 | Invention | II-17 | 21 | 45 |
| 11 | Comparison | P-1 | 23 | 39 |

TABLE 3

| Sample | A Fog O, yw | mg | cy | B Fog O, yw | mg | cy |
|---|---|---|---|---|---|---|
| 6 | 7 | 8 | 8 | 12 | 10 | 9 |
| 7 | 7 | 7 | 7 | 10 | 9 | 8 |
| 8 | 7 | 6 | 6 | 10 | 9 | 8 |
| 9 | 7 | 6 | 7 | 10 | 9 | 8 |
| 10 | 5 | 7 | 7 | 10 | 9 | 8 |
| 11 | 7 | 8 | 8 | 13 | 10 | 9 |

The Example shows that the light stability of the image dyes is improved by using the compounds according to the invention.

Although the polymer P-1 according to EP 542 053 used for comparison does produce an improvement in light stability, the samples all show distinctly higher discoloration of the white areas (A) of the image and unwanted higher discoloration of the white areas (B) of the image after storage in the conditioning cabinet (Table 3).

Example 3

A color photographic recording material was produced by applying the following layers in the order shown to a paper coated on both sides with polyethylene. The quantities shown are all based on 1 square meter. For the silver halide applied, the corresponding quantities of $AgNO_3$ are shown.

Layer combination 1

1st layer (substrate layer)
2 g of gelatine
2nd layer (blue-sensitive layer)
blue-sensitive silver halide emulsion (99.5 mol-% of chloride, 0.5 mol-% of bromide, mean particle diameter 0.78 μm) of 0.50 g of $AgNO_3$ containing
1.38 g of gelatine
0.60 g of yellow coupler Y-21
0.48 g of TCP
3rd layer (interlayer)
1.18 g of gelatine
0.08 g of 2,5-dioctyl hydroquinone
0.08 g of dibutyl phthalate (DBP)
4th layer (green-sensitive layer)
green-sensitized silver halide emulsion (99.5 mol-% of chloride, 0 5 mol-% of bromide, mean particle diameter 0.37 μm) of 0.40 g of $AgNO_3$ containing
1.02 g of gelatine
0.37 g of magenta coupler M-1
0.40 g of DBP
5th layer (interlayer)
1.20 g of gelatine
0.66 g of UV absorber corresponding to the following formula:

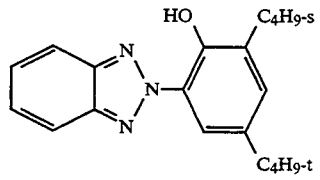

0.052 g of 2,5-dioctyl hydroquinone
0.36 g of TCP
6th layer (red-sensitive layer)

red-sensitized silver halide emulsion (99.5 mol-% of chloride, 0.5 mol-% of bromide, mean particle diameter 0.35 μm) of 0.28 g of $AgNO_3$ containing
0.84 g of gelatine
0.39 g of cyan coupler C-1
0.39 g of TCP
7th layer (UV-absorbing layer)
0.65 g of gelatine
0.21 g of the same UV absorber as in the 5th layer
0.11 g of TCP
8th layer (protective layer)
0.65 g of gelatine
0.39 g of a hardener corresponding to the formula:

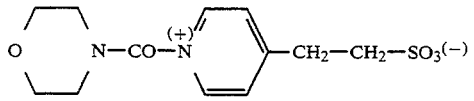

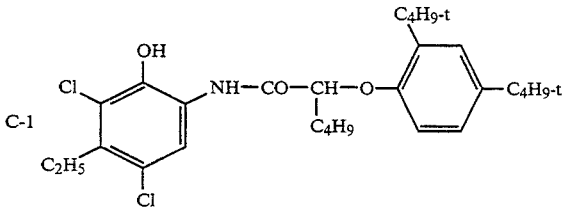

C-1

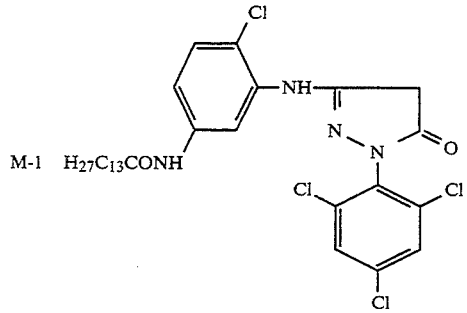

M-1 $H_{27}C_{13}CONH$

In the Examples according to the invention, the TCP in the 2nd layer of the layer combination was replaced by the same quantity by weight of a polymer according to the invention.

Samples of the materials were then exposed behind a graduated grey wedge. The materials were then processed in the usual way in the following processing baths:

| | |
|---|---|
| a) Color developer - 45 s - 35° C. | |
| Triethanolamine | 9.0 g/l |
| N,N-diethyl hydroxylamine | 4.0 g/l |
| Diethylene glycol | 0.05 g/l |
| 3-Methyl-4-amino-N-ethyl-N-methane-sulfonamidoethyl aniline sulfate | 5.0 g/l |
| Potassium sulfite | 0.2 g/l |
| Triethylene glycol | 0.05 g/l |
| Potassium carbonate | 22 g/l |
| Potassium hydroxide | 0.4 g/l |
| Ethylenediamine tetraacetic acid disodium salt | 2.2 g/l |
| Potassium chloride | 2.5 g/l |
| 1,2-Dihydroxybenzene-3,4,6-trisulfonic acid trisodium salt | 0.3 g/l |
| Make up with water to 1,000 ml; pH 10.0 | |
| b) Bleaching/fixing bath - 45 s - 35° C. | |
| Ammonium thiosulfate | 75 g/l |
| Sodium hydrogen sulfite | 13.5 g/l |
| Ammonium acetate | 2.0 g/l |
| Ethylenediamine tetraacetic acid | 57 g/l |

-continued

| | |
|---|---|
| (iron ammonium salt) | |
| Ammonia, 25% by weight | 9.5 g/l |
| Acetic acid | 9.0 g/l |
| Make up with water to 1,000 ml; pH 5.5 | |

c) Washing—2 mins.—35° C.
d) Drying

The dye images obtained were xenotested ( 14.4 million Lxh) at different yellow densities in accordance with ISO 10 977 (½ fog correction). The results are set out in Table 4.

TABLE 4

| Sample | | Oil former/ polymer | Reduction in % in yellow color density at Density 0.6 | Density 1.0 | Density 1.4 |
|---|---|---|---|---|---|
| 12 | Comparison | TCP | 24 | 17 | 17 |
| 13 | Invention | II-14 | 21 | 14 | 13 |
| 14 | Invention | I-2 | 19 | 12 | 11 |
| 15 | Invention | I-1 | 20 | 11 | 12 |

Example 4

The following two layers were applied to a paper coated with polyethylene on both sides. The quantities shown are based on 1 square meter.

1st layer
blue-sensitive silver halide emulsion according to Example 1 of 0.6 g of $AgNO_3$
2 g of gelatine
0.8 g of yellow coupler Y-21
0.6 g of TCP
2nd layer (protective layer)
2 g of gelatine
0.4 g of the hardener according to Example 1

Processing is carried out in the same way as in Example 1.

The processed material was stored in a conditioning cabinet (for 21 days at 80° C./50% relative humidity), the yellow dye according to the following Table decomposing into colored products. Using a hand densitometer, the densities were determined behind red and green filters before and after storage in the conditioning cabinet (at density 2.0 behind a blue filter before storage). The percentage increases in density are shown in Table 5.

TABLE 5

| Sample | | Polymer/ oil former | Additional density in % at Yellow starting density 2.0 measured behind a green filter | Yellow starting density 2.0 measured behind a red filter |
|---|---|---|---|---|
| 17 | Comparison | TCP | 15 | 43 |
| 18 | Invention | II-14 | 10 | 29 |
| 19 | Invention | I-2 | 8 | 31 |
| 20 | Invention | I-1 | 10 | 27 |
| 21 | Comparison | P-1 | 11 | 32 |

In the case of samples 18 to 20, the increase in secondary densities through storage in the conditioning cabinet is significantly smaller than in the case of the comparison samples. As a result, natural color reproduction remains intact, even after storage in the conditioning cabinet.

We claim:

1. A color photographic recording material comprising at least one silver halide emulsion layer and a color coupler associated with that layer, characterized in that, in the silver halide emulsion layer or in a non-photosensitive binder layer adjacent thereto, it contains a combination of a color coupler and a compound corresponding to general formula (I) or (II):

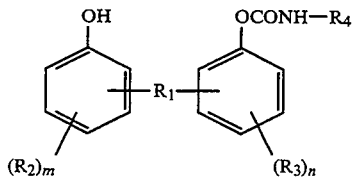

(I)

in which $R_1$ is a chemical bond or a difunctional bridge member, $R_2$ and $R_3$ are the same or different and are alkyl, alkoxy, alkenyl, cycloalkyl, aryl or aryloxy or two substituents $R_2$ and $R_3$ represent the remaining atoms of a benzene ring condensed with the phenyl group m and n are the same or different and are a number from 0 to 3, and one of the substituents $R_1$ or $R_2$ or $R_3$ in each of the two phenyl rings corresponding to formula (I) being in the p-position to the oxygen and $R_4$ is the residue of a polymer produced by polycondensation,

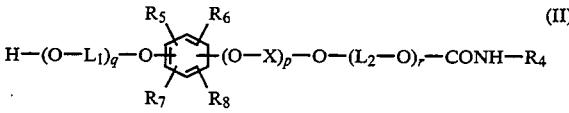

(II)

in which $L_1$ and $L_2$ are the same or different and represent an optionally substituted, difunctional organic radical attached to the oxygen atoms by aliphatic or aromatic carbon atoms, X is an optionally substituted difunctional organic radical attached to the oxygen atoms by aliphatic or aromatic carbon atoms, p is the number 0 or 1 q and r are the same or different and are a number from 0–20, $R_5$, $R_6$, $R_7$ and $R_8$ are the same or different and represent H, alkyl, aryl, acyl, aralkyl, alkylamino, arylamino, halogen, alkoxy, aryloxy, —$SO_2$—$NR_9R_{10}$, —$NR_9$—$SO_2$—$R_{10}$, —$CONR_9R_{10}$, —$NR_9COR_{11}$, —$OCOR_{10}$ or —$COOR_9$, $R_9$ presents H or alkyl, $R_{10}$ represents H, alkyl, aralkyl or aryl, $R_{11}$ represents alkoxy, aroxy, alkylamino, arylamino, H, alkyl, aryl, acyl, aralkyl, halogen, aryloxy, —$SO_2$—$NR_9R_{10}$, —$NR_9$—$SO_2R_{10}$, —$CONR_9R_{10}$, —$OCOR_{10}$ or —$COOR_9$, X may optionally form a 5- or 6-membered ring with $R_5$, $R_6$, $R_7$ or $R_8$ and $R_4$ is the residue of a polymer produced by polycondensation.

2. A color photographic silver halide material as claimed in claim 1, wherein the compound corresponding to formula (I) is used in the at least one blue-sensitive yellow-coupling layer in a quantity of 0.1 to 2 mol/mol of coupler.

3. A color photographic silver halide material as claimed in claim 1, wherein the yellow coupler is a 2-equivalent pivaloyl coupler of which the leaving group is attached to the coupling position either by oxygen or by nitrogen.

4. A color photographic silver halide material as claimed in claim 1, wherein at least 80 mol-% of the silver halide emulsions are AgCl emulsions.

5. The color photographic silver halide material as claimed in claim 1, wherein $R_7$ and $R_8$are hydrogen, $L_1$ and $L_2$ are identical or different and are $C_2$–$C_8$ alkylene chains, p is 0, q and r are identical or different and are from 0 to 20.

6. The color photographic silver halide material as claimed in claim 5, wherein $L^1$ and $L^2$ are the same or different and are $C_2$–$C_4$ alkylene and q and r are identical or different and are from 0 to 3.

7. The color photographic silver halide material as claimed in claim 6, wherein $R_5$ and $R_6$ are identical or different and are hydrogen, alkyl, aryl, acyl, —$SO_2$—$NR_9R_{10}$, —$NR_9$—$SO_2$—$R_{10}$, —$CONR_9R_{10}$ or —$NR_9COR_{11}$, in which $R_9$ represents H or aryl, $R_{10}$ represents H, alkyl, aralkyl or aryl, $R_{11}$ represents alkoxy, aroxy, alkylamino, arylamino, H, alkyl, aryl, acyl, aralkyl, halogen, aryloxy, —$SO_2$—$NR_9R_{10}$, —$NR_9$—$SO_2$—$R_{10}$, —$CONR_9R_{10}$, —$OCOR_{10}$ or —$COOR_9$.

8. The color silver halide material as claimed in claim 1, wherein the compounds of formula II are selected from the group consisting of

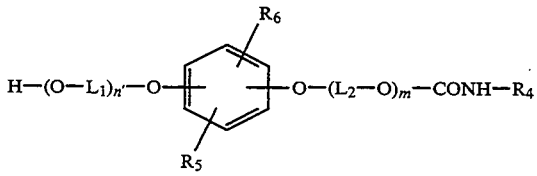

II-A

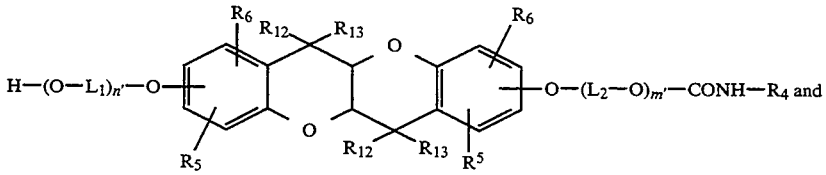

II-B

-continued

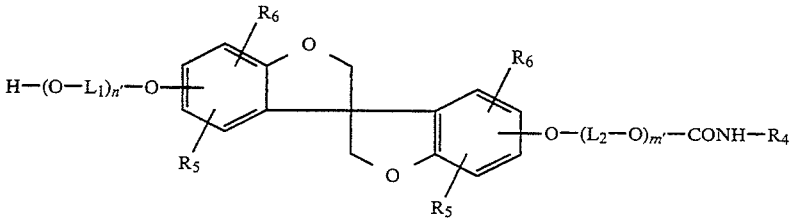

II-C in which $R_{12}$ and $R_{13}$ are identical or different and represent hydrogen or alkyl and n' and m' are identical or different and are from 0 to 20 and $L_1$, $L_3$, $R_4$, $R_5$, $R_6$ are defined in claim 1.

9. The color silver halide material as claimed in claim 8, wherein n' and m' are numbers from 1 to 5 and $L_1$ and $L_2$ are $C_2$–$C_4$ alkylene chains and $R_5$ and $R_6$ arc identical or different and are hydrogen, alkyl, aryl, acyl, $—SO_2—NR_9R_{10}$, $—NR_9—SO_2—R_{10}$, $—CONR_9R_{10}$ or $—NR_9COR_{11}$, in which $R_9$ represents H or alkyl, $R_{10}$ represents H, alkyl, aralkyl or aryl, $R_{11}$ represents alkoxy, aroxy, alkylamino, arylamino, H, alkyl, aryl, acyl, aralkyl, halogen, aryloxy, $—SO_2—NR_9R_{10}$, $—NR_9—SO_2—R_{10}$, $—CONR_9R_{10}$, $—OCOR_{10}$ or $—COOR_9$.

10. The color photographic silver halide material as claimed in claim 1, wherein $R_4$ is a polyester, polyether, polycarbonate, polyurethane or polyesterpolyurethane.

11. The color photographic silver halide material as claimed in claim 1, wherein $R_5$, $R_6$, $R_7$ and $R_8$ are the same or different and represent alkyl wherein said alkyl is linear, branched, cyclic, unsubstituted or substituted.

* * * * *